US006071382A

United States Patent [19]

Tsuchiya et al.

[11] Patent Number: 6,071,382

[45] Date of Patent: Jun. 6, 2000

[54] SHEET MEASUREMENT AND CONTROL SYSTEM

[75] Inventors: Akihiko Tsuchiya; Tomohiro Mineo; Takao Maruyamam; Atsushi Kodama; Yukihiro Seki; Takahashi Sasaki, all of Tokyo, Japan

[73] Assignee: Yokogawa Electric Corporation, Tokyo, Japan

[21] Appl. No.: 09/072,108

[22] Filed: May 4, 1998

[30] Foreign Application Priority Data

May 15, 1997 [JP] Japan ..... 9/125480
Jun. 6, 1997 [JP] Japan ..... 9/148975

[51] Int. Cl.[7] ..... D21F 7/00

[52] U.S. Cl. ..... 162/252; 162/252; 162/253; 162/263; 162/198; 162/DIG. 10

[58] Field of Search ..... 162/198, 252, 162/263, 253, DIG. 10; 364/471.02

[56] References Cited

U.S. PATENT DOCUMENTS 5,022,966 6/1991 Hu ..... 162/198

*Primary Examiner*—Peter Chin
*Attorney, Agent, or Firm*—Moonray Kojima

[57] ABSTRACT

A sheet measurement and control system that enables easy installation and/or change of types of sensors to be disposed in or about a sensor head that reciprocally scans a sheet along a cross direction transverse to the sheet flow; wherein a plurality of sensors are disposed in or about the sensor head to measure characteristics of the sheet; a plurality of computation devices corresponding to the plurality of sensors are disposed in or about the sensor head to implement computation of the measuring signals from the sensors; a plurality of communication control devices corresponding to the plurality of computation devices are disposed in or about the sensor head for transmitting the processed measuring signals through a general network communication link attached thereto; and man-machine interface connected to the general network communication link monitors data from said communication control devices related to the measured signal and issues instructions to control the sheet manufacturing process.

5 Claims, 6 Drawing Sheets

SHEET MEASUREMENT AND CONTROL SYSTEM

BACKGROUND OF THE INVENTION

1. Field of Invention

This invention relates to a system for measuring the surface densities, thickness, and the like, of sheet materials, such as paper, plastic, rubber, etc.; and more particularly, to improvements in the distribution functions of a microprocessor in a sensor control/computation unit of a sensor. This invention also relates to a man-machine interface unit used in a control system for a paper manufacturing or coating machine; and more particularly, to improvements therein which produce legible display even when the number of final control elements is greatly increased.

2. Description of the Prior Art

In the paper making industry, basis weight, moisture content, thickness, gloss, color, etc., are measured to assess paper quality. In order to control paper quality to targeted values, a sheet measurement and control system is used. An example of such system is disclosed in Japanese Unexamined Patent Application Hei 8-61,942 (1996).

FIG. 1 shows a sheet measurement control system, wherein measurement frame 30 is a rectangular frame spanned in a cross direction (which is defined herein as being in a direction which is transverse to the travel direction, labeled herein as "machine direction") of sheet 40. Sensor head 32 is caused to move back and forth (see arrow) along this frame 30 on the front and rear surfaces of the sheet 40 to provide reciprocal scanning of sheet 40. Since a sheet manufacturing machine continuously manufactures and moves sheet 40 in the machine direction, the running locus of the sensor head 32 above the sheet 40 shows a zig zag pattern or trace. The Measurement Frame and Sensor Management Unit 34 implements data processing and computation using the measured sensor signals and the measured sensor positions in the cross direction. In this sheet measurement and control system, data are processed to separate the computed data into a component in the machine direction and another component in the cross direction.

Man-Machine Interface 52 is disposed in a location independent of measurement frame 30 to enable an operator to more conveniently and easily observe the running state of the sheet manufacturing system. For example, the data component in the cross direction of the measured value computed with Measurement Frame and Sensor Management Unit 34 is called a "profile". The profile is displayed so that the operator can monitor the uniformity of the sheet quality in the cross direction.

FIG. 2 shows a conventional small scale measurement and control system, wherein three types of units, sensors 10. sensor processor 14, and communication processor 16 are mounted in sensor head 32. Two different types of sensors 10, for example,are mounted in sensor head 32. However, two similar types of sensors can also be used. For example, in a basis weight meter, if promethium-147 ($^{147}$Pm) is used as a Beta source, measurement accuracy is good but the measurement range is limited to 0 to 100 g/cm$^2$. On the other hand, if strontium-90 ($^{90}$Sr) is used as the beta source, measurement accuracy is not as good, but the measurement range is extended to 0 to 2000 g/cm$^2$, that is by about one decade or more. Thus, when paper of large basis weight and paper of small basis weight have to be manufactured using the same paper making process and changing the recipe, this can be done by switching the beta source between the promethium-147 and the strontium-90.

A sensor processor 14 is provided for each sensor 10 and corrective computation is carried out on the analog output signals from each of the sensors to compute the instantaneous measured values. The computed instantanous measured values are then sent consecutively to a communication processor 16. Communication processor 16 is also disposed in sensor head 32 and is connected to each sensor processor 14 on a 1 to N basis, and exchanges data with each sensor processor 14 by direct access corresponding to requests from a supervisory computer. For example, the instantaneous measured values computed each sensor processor 14 are stored serially with time and the resulting time series data are sent to operation processor 36 at the request of operation processor 36.

The operation processor 36 is disposed on the measurement frame 30. It creates profiles representing sheet quality in the cross direction by combining the time series instantaneous measured value data, sent from communication processor 16, with the positional data of sensor head 32 in the cross direction. The processor 36 also eliminates measurement noise components using, for example, a smoothing process. The operation processor 36 is connected to communication processor 16 with signal cable 24. In addition, the man-machine interface 52 fetches required data by accessing the operation processor 36 and displays the data so that an operator can conveniently and easily observe the running state of the sheet manufacturing system.

In the conventional system, analog signals outputted from sensor 10 are delivered to sensor processor 14 and then to communication processor 16. By the operations discussed above, the measured values are transmitted ultimately from sensor 10 to operation processor 36. The signal cable 24 is suitable for digital high speed communication.

Furthermore, in order to show paper quality, a profile display unit, such as disclosed in Japan Unexamined UM Sho 63/175,198 (1988) may be used. FIG. 3 shows a display screen of the profile data, wherein line (A) shows profiles of measured values PV and set values SV; line (B) shows a profile of manipulated variable MV; and line (C) shows a position cursor. The measured values PV and the set values SV are displayed with line segment graphs, and the manipulated variables MV are displayed with bar graphs. The horizontal axis shows the positions in the cross direction. The position cursor is displayed under the MV profile display and also serves as an input device to specify a final control element selected from a plurality of final control elements.

However, since several sets of sensors 10 and corresponding sensor processors 14 are fed into communication processor 16, it is also necessary for the communication processor 16 to be changed when the type of sensor 10 is changed. The work involved in replacing sensor 10 is time consuming and complex. In addition, only a single sensor 10 can be mounted on the sensor head 32 in some application In such applications, since the communication processor 16 has to handle a plurality of sensors 10, the cost is increased.

Furthermore, recently, CP control of the basis weight has been used, wherein the inlet pulp concentration is locally adjusted by opening and closing multiple valves arranged in the cross direction of the paper sheet. Compared with other conventional basis weight control that adjusts the slice bolt, in the CP control system, the number of manipulated variables MV is increased considerably. For example, the number of valves might reach several hundred in one case. This results in the manipulated variables being displayed in a profile data display close together, thereby making identification by the cursor more difficult.

SUMMARY OF THE INVENTION

Accordingly, an object of the invention is to overcome the aforementioned and other deficiencies, disadvantages and problems of the prior art.

Another object is to provide a sheet measurement and control system that enables easy replacement and/or change of types of sensors disposed in a sensor head.

A further object is to provide a sheet measurement and control system wherein the manipulated variable can be easily identified even when the number of manipulated variables is increased.

The foregoing and other objects are attained by the sheet measurement and control system of the invention, which is used for a sensor head that reciprocally scans a sheet in the cross direction transverse to the sheet flow direction, and wherein a plurality of sensors are mounted on the sensor head to measure the various characteristic variables of the sheet; a plurality of sensor computation means corresponding to the plurality of sensors are mounted on the sensor head, which implement computation necessary for the measurement signals outputted from the sensors; a plurality of communication control means corresponding to the plurality of computation means are mounted on the sensor head and connected to a general network communication link; a man-machine interface is provided to monitor and control the state of the sheet manufacturing process by exchanging information with the relevant computation processor through communications, and a general network communication link is connected to the communication control means and the man-machine interface.

Advantageously, the invention simplifies replacement work when the sensors are changed because each sensor is mounted on the sensor head and corresponds to the sensor computation means and the communication control means. Since the use of a general network communication link is universally accepted, communication between the communication control means and the man-machine interface is easily performed in accordance with a general communication protocol.

The sheet measurement and control system of the invention is provided with a zoom-in display means that displays the manipulate, variables of the final control elements by zooming in thereon in the cross direction of a paper machine control system comprising a profile data sampling/setting equipment that acquires as profile data a distribution of measured values PV obtained in the cross direction of the sheet of paper, manipulated variables MV of the final control elements, and set values SV for desired paper quality; a profile data holding equipment that retains the profile data acquired by the profile data sampling/setting equipment; a display equipment that displays the measured values, manipulated variables, and set values retained by the profile data holding equipment as a distribution in the cross direction of the paper; and an input equipment that manually specifies set values and manipulated variables to the display equipment. The zoom-in display means enables smooth and easy selection of final control elements, even when the final control elements indicated in the display equipment are close to each other because of the existence of a plurality of control elements, such as in a CP control of basis weight.

DETAILED DESCRIPTION OF THE PREFERRED EMBODIMENTS

Figure 4:
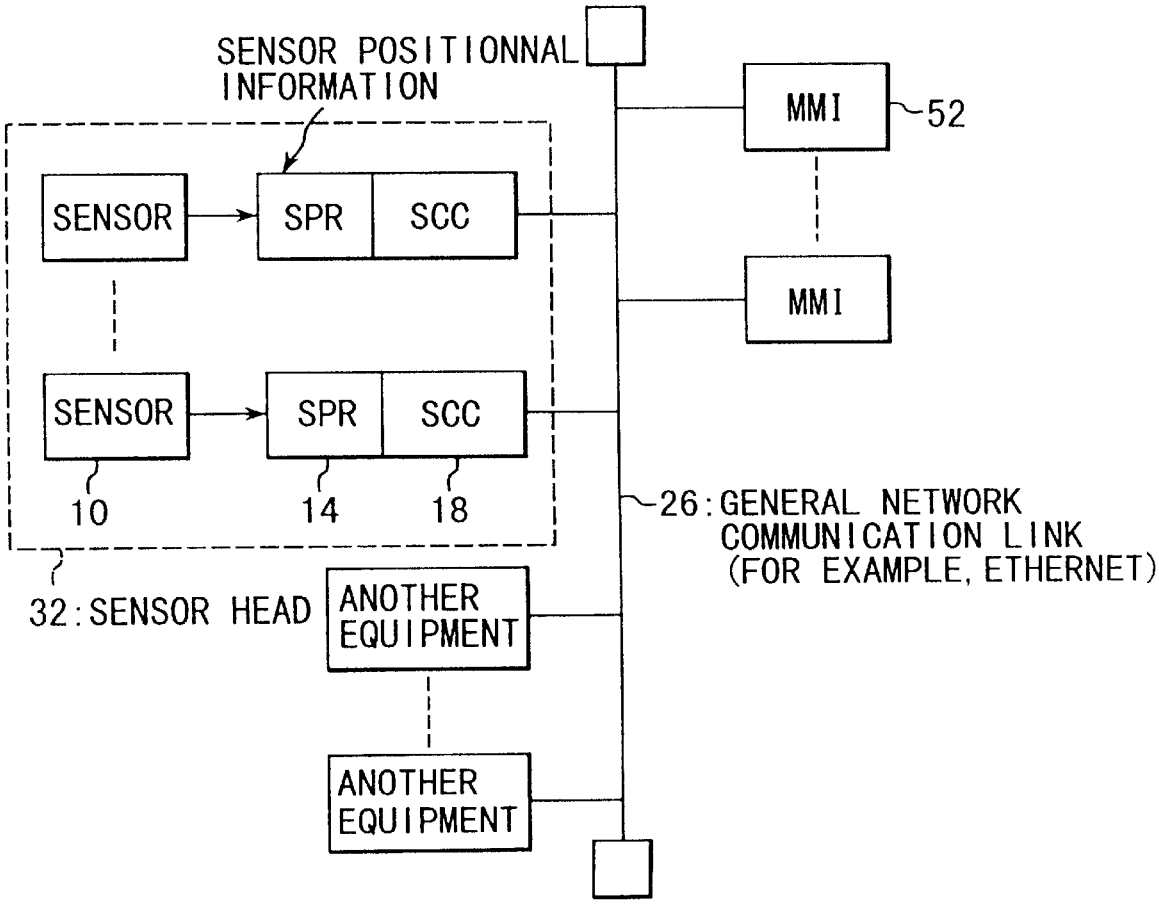
FIG. 4 is a block diagram depicting an illustrative embodiment of the invention.

Turning to FIG. 4, a plurality of sensor processors (SPR) 14 are connected to respective ones of a plurality of sensors 10 and compute paper profiles by combining the measurement signals from the respective sensors with separately transmitted sensor positional information. Another equipment is mounted inside or outside of measurement frame 30 (see FIG. 1) and manages the driving sequence of the sensor head 32 along the measurement frame 30. Another equipment may be a Sensor Communication Card (SCC) 18 that can be connected to the Ethernet, Sensor Processor (SPR)14, or a sensor 10 As depicted, the sensor 10, Sensor Processor 14, and Sensor Communication Card 18, are disposed in or about the sensor head 32.

A plurality of Sensor Communication Cards (SCC) 18 are provided for each respective one of the plurality of Sensor Processors (SPR) 14 and have a communication control function for communicating the results computed by Sensor Processor (SPR) 14 to the Man-Machine Interface 52 using the General Network Communication Link 26. The General Network Communication Link 26 is, for example, the Ethernet (a registered trademark) conforming to general purpose communication standards. As the communication standards of this type, for example 10BASE-5/2 or the like, conforming to the LAN protocol, such as IEEE802.3 and others , is used. Man-Machine Interface (MMI) 52 displays profiles transmitted through the General Network Communication Link 26 to enable uniformity in sheet quality in the cross direction to be conveniently and easily monitored.

Figure 1:
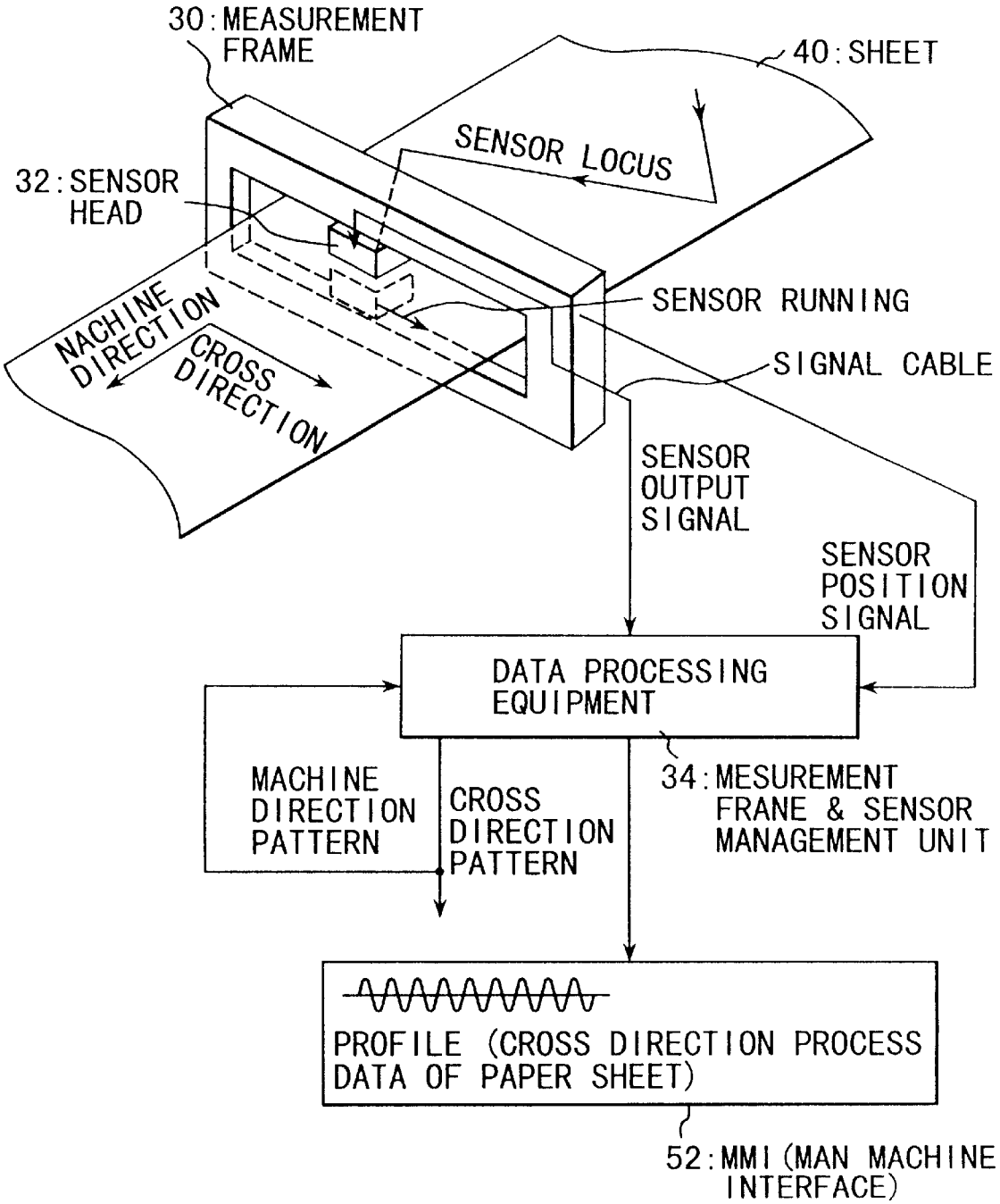
FIG. 1 (PRIOR ART)
FIG. 1 is a perspective view depicting a conventional sheet measurement and control system.
Figure 2:
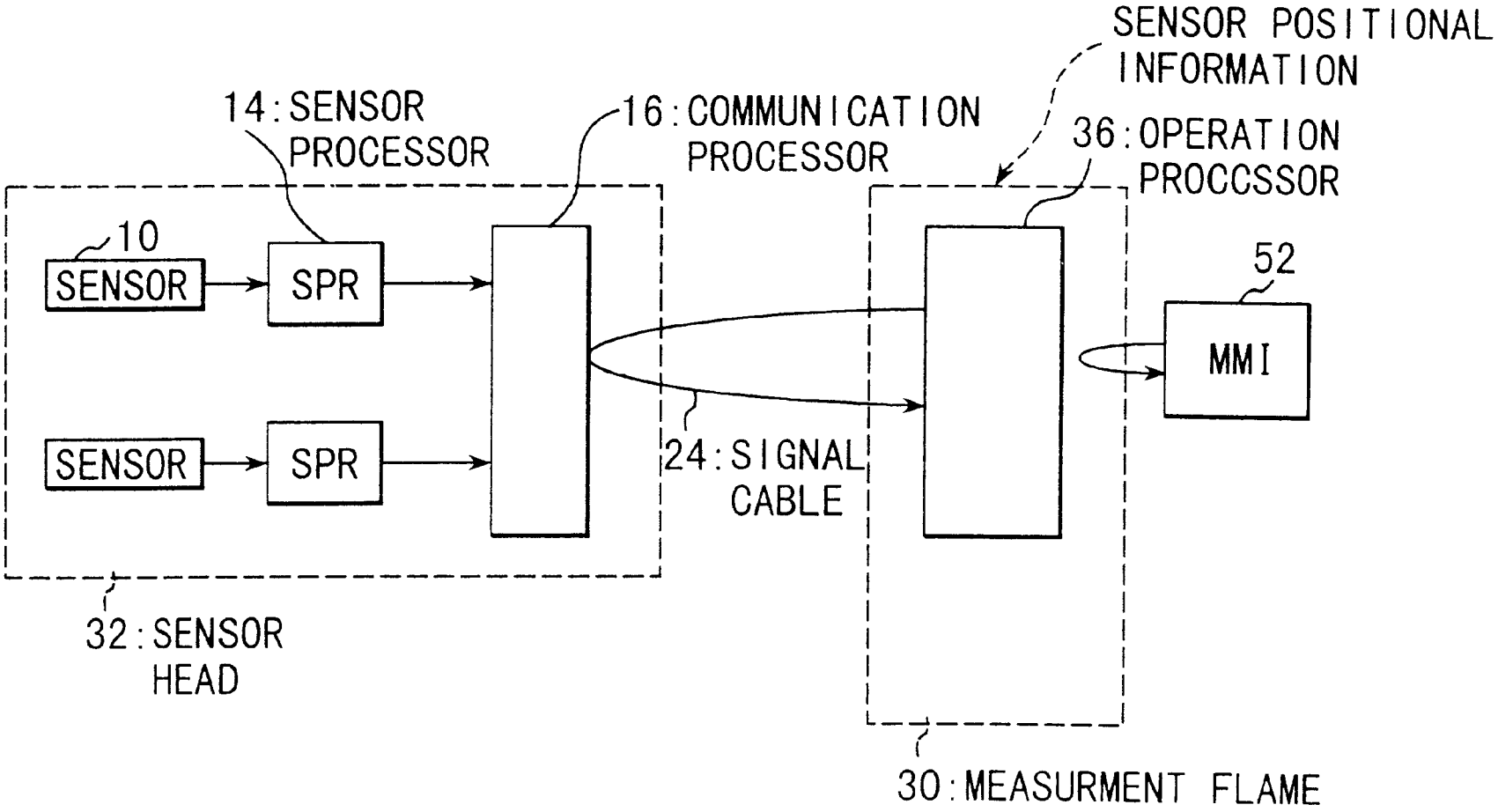
FIG. 2 (PRIOR ART)
FIG. 2 is a block diagram depicting a conventional small scale sheet measurement and control system.
Figure 3:
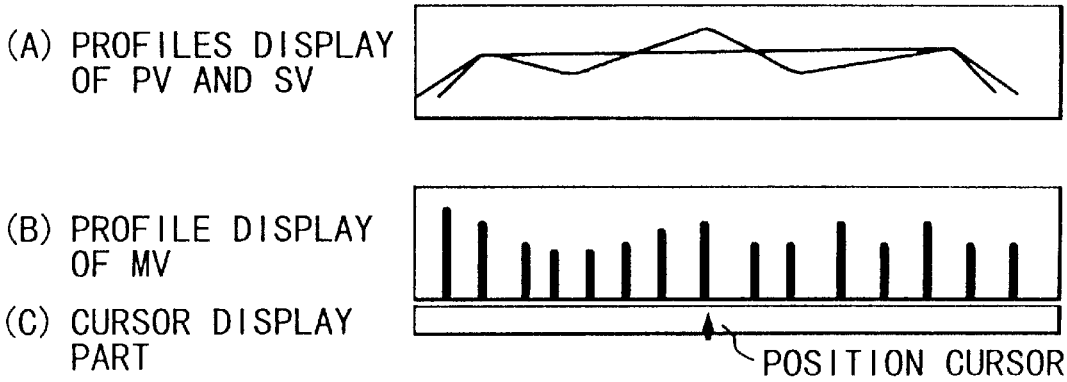
FIG. 3 (PRIOR ART)
FIG. 3 is a drawing depicting a profile data display screen.
Figure 5:
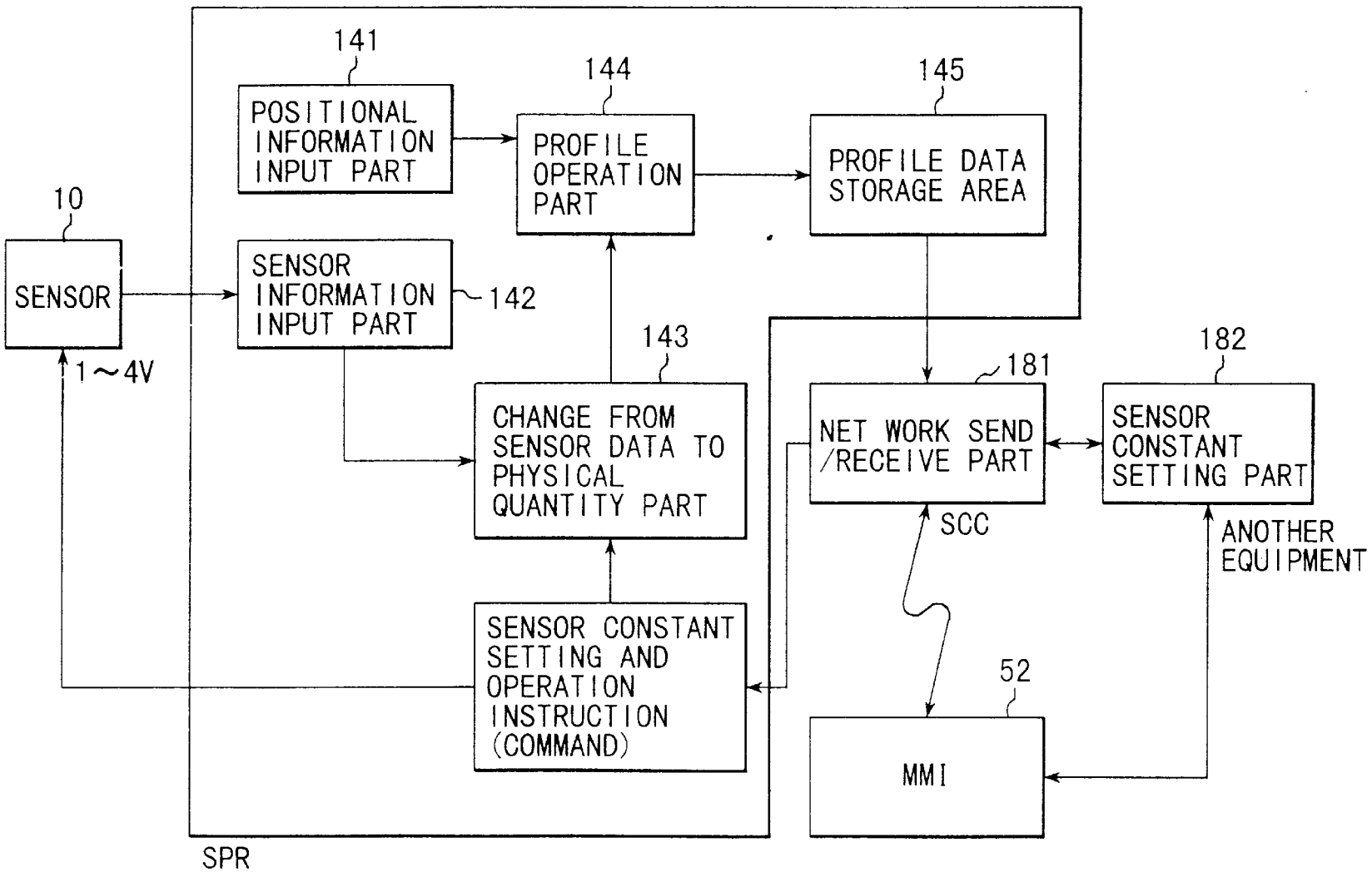
FIG. 5 is a block diagram useful in explaining the function of a sensor processor.

The function of the Sensor Processor (SPR) 14 is described with reference to FIG. 5, wherein the Positional Information Input Part acquires data on the positions of the sensor head 32 in measurement frame 30 (see FIG. 1). If the sensors 10 are mounted in the sense head 32 in multiple rows, information on accurate sensor positions can be determined by setting offset values for each sensor 10 in advance.

The Sensor Information Input Part 142 converts input instantaneous values of measured signals transmitted from the sensor 10 into digital signals. The Sensor Information Input Part 142 may comprise, for example, an analog-digital converter having a required number of digits or the like. Change From Sensor Data to Physical Quantity Part 143 converts a signal received by the Sensor Information Input Part 142 from sensor 10 and outputted thereby into a physical quantity, for example, into a quantity in [%] for moisture and into a quantity in [g/m$^2$] for basis weight. The Profile Operation Part 144 combines the sensor positional information from the Positional Information Input Part 141 with the measured data from the Change from Sensor Data To Physical Quantity Part 143 to compute a profile representing the distribution of measured values in the cross direction of a sheet of paper. The Profile Data Storage Are 145 stores the data computed in the Profile Operation Part 144 on each scan resulting from one reciprocal movement of the sensor head 32 in frame 30.

The Network Send/Receive Part 181 serves as a kernel of the communication control function in the Sensor Communication Card (SSC) 18 (see FIG. 4) and sends the profile data, or the like, stored in the Profile Data Storage Area 145 to the Man-Machine Interface (MMI) 52 via the General Network Communication Link 26. The Man-Machine Interface 52 implements communication, commanding measurement start or requesting the sending of the profile data to the Network Send/Receive Part 181 via the General Network Communication Link 26. The Sensor Constant Setting Part 182 sends the positional information from the sensor head 32 to the Network Send/Receive Part 181 to help the data transmission timing.

Operation of the system is as follows. First an analog output signal from sensor 10 is digitized by Sensor Information Input Part 142. The digitized input signal is then subjected to sensor control and measurement computation by Change From Sensor Data To Physical Quantity Part 143 and Profile Operation Part 144 and a profile is thereby generated. In the system, since sensor input signal processing is implemented entirely within the Sensor Processor 14, a super visory Man-Machine Interface 52 manages only the requesting of data from the Sensor Processor 14. Thus, operation processor 36, that has been used to date, becomes unnecessary.

If the sensors 10 are desired to be changed or increased, such replacement or increase is accomplished with the set of the Sensor Processor 14 and Sensor Communication Card 18. In this case since the Sensor Communication Card 18 is of a type that can be conected to the General Network Communication Link 26, such as the Ehternet, th sensors can be increased anywhere on the bus. Thus, advantageously, the sensors can be located in a variety of places.

In the embodiment, although the General Network Communication Link 26 uses the Ethernet, as an example, other general purpose networks can also be used. Thus, it will be appreciated that the invention may be embodied in other forms without departing from the spirit thereof.

As described, in a sheet measurement and control system of the invention, the sensor can be easily replaced because the sensors which are mounted on the sensor head, are provided corresponding on a one for one basis to each sensor computation means and communication control means. Since the use of the General Network Communication Link 26 is universally accepted, advantageously, with the invention, communication between the communication control means and the man-machine interface can be easily performed in accordance with a general communication protocol, and the mounting position of the sensor can also be freely selected.

Figure 6:
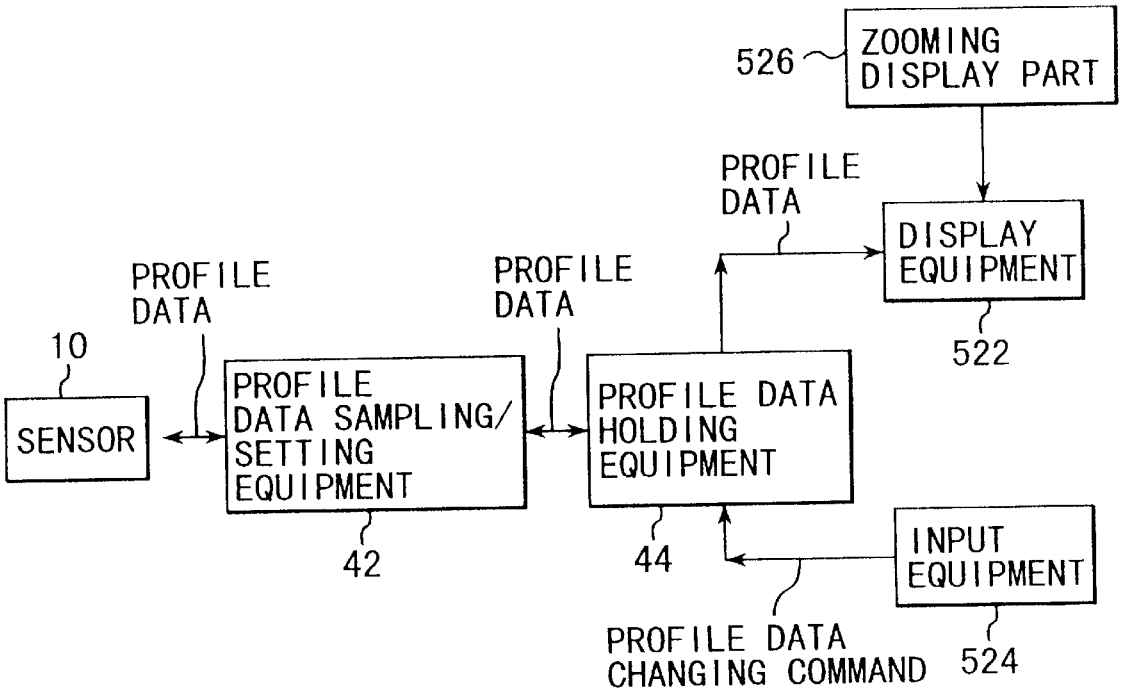
FIG. 6 is a block diagram depicting a profile data display indicating another illustrative embodiment of the invention.

FIG. 6 shows a profile data display, wherein sensor 10 measures the basis weight of paper manufactured with a paper making machine, or the like. For example,a radiation basis weight sensor or infrared moisture sensor may be used as the sensor 10. The Profile Data setting Equipment 42 acquires a distribution of measured values PV obtained in the cross direction of the sheet of paper, manipulated variables MV of the final control elements, such as a slice bolt, and set values SV for paper quality, as the profile data. For example, the Profile Operation Part 144 (see FIG. 5) may comprise a block that combines the measuring positions in the cross direction of the sensor 10 with the measured values PV corresponding to the equipment. 42. The Profile Data Holding Equipment 44 stores the measured values obtained by measurement (at tens to hundreds of points) in the cross direction by the sensor 10 scanning in the cross direction. The stored value, for example, corresponds to the Profile Data Storage Area 145. The display equipment 522 displays the measured values PV, the manipulated variables MV, and the set values SV retained in the Data Holding Equipment 44 as the distribution in the cross direction. Input equipment 524 manually specifies the set values SV and/or the manipulated variables MV to display equipment 522. Zoom-in window Display Part 526 displays the measured values PV and the set values SV by zooming in thereon in the cross direction by the same ratio as the manipulated variables MV of the final control elements.

In the embodiment, the Input Equipment 524 moves the position cursor to identify a set value SV or a manipulated variable MV. Then, the set value SV or the manipulated variable MV is changed corresponding to the input operation and the values are transmitted to Profile Data Holding Equipment 44. Furthermore, the Profile Data Holding Equipment 44 transmits the setting operation to the Profile Data Sampling/Setting Equipment 42. The measured values PV, the manipulated variables MV, and the set values SV retained in the Profile Data Holding Equipment 44, are updated by the Profile Data Sampling/Setting Equipment 42 or by the Input Equipment 524. In addition, the measured values PV and the manipulated variables MV are set to a paper making machine control system not shown in the drawing, and a PID control or fuzzy control is implemented so that the profile agrees with the target values.

Figure 7:
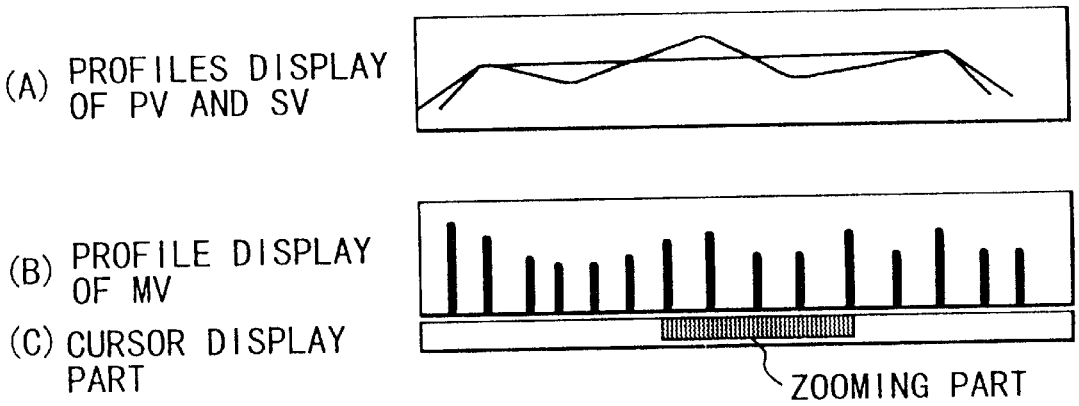
FIG. 7 is a drawing depicting a profile data display screen.

Operation of the embodiment will now be described with reference to FIG. 7, which shows a profile data display screen, and wherein line (A) shows a profile display for the measured values PV and the set values SV; line (B) shows a profile display for the manipulated variables MV; and line (C) shows a display of the position cursor. The measured values PV and the set values SV are shown with the line segment graphs, respectively, and the manipulated variables MV are shown with bar graphs. The horizontal axis for the graphs indicates positions in the cross direction of the sheet of paper. The position cursor is shown under the profile display for the manipulated variables MV and when a zoom-in window display is to be used, a zoom-in part in the cross direction is displayed in the cursor display part.

Figure 8:
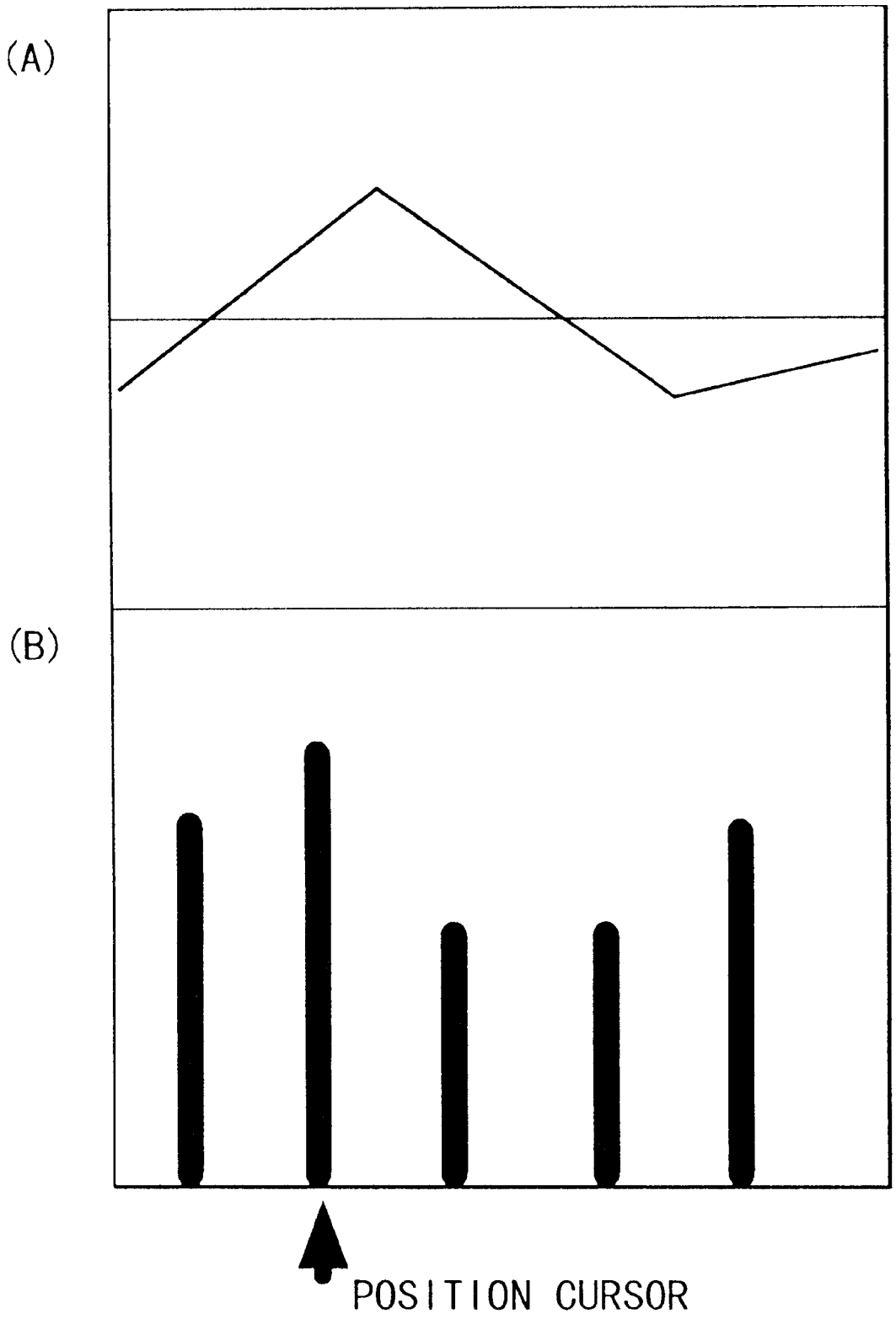
FIG. 8 is a drawing depicting a zoom-in window display.

FIG. 8 shows a zoom-in window display, wherein line (A) shows a profile display for the measured values PV and the set values SV; and line (B) shows a profile display for the manipulated variables MV. In the zoom-in window display, the manipulated variables MV for the final control elements, the measured values PV, and the set values SV are displayed by being zoomed-in in the same ratio as the cross direction. When a zoom-in window display is provided in the Display Equipment 522, information from the Input Equipment 524 is reflected in both the zoom-in window display and the original display. In addition, in the embodiment, both the zoom-in window display and the original display may be shown on the screen. Also, the zoom-in window display only can be shown.

As mentioned above, in the profile display equipment of the embodiment, a zoom-in display means is provided by which the manipulated variables of the final control elements can be zoomed-in in the cross direction. This enables the operator to conveniently, smoothly and easily select the final control elements through use of the zoom-in display. This can be done even when the final control elements indicated in the display equipment are close to each other and are many in number, such as in CP control used for basis weight.

The foregoing description is illustrative of the principles of the invention. Numerous modifications and extensions thereof would be apparent to the worker skilled in the art. All such modification and extensions are to be considered to be within the spirit and scope of the invention.

What is claimed is:

1. In a sheet measurement and control system used for a sensor head which reciprocally scans a sheet in a cross direction transverse to direction of sheet flow, said system comprising:

sensor means disposed in said sensor head for measuring one or more variables of characteristics of said sheet;

computation means disposed in said sensor head and connected to said sensor means for processing measuring signals outputted by said sensor means; and interface means for monitoring and controlling sheet manufacturing process by monitoring said one or more variables of characteristics of said sheet as measured by said sensor means and by instructions entered into said interface means in response to the monitoring;

the improvement comprising:

communication control means disposed in said sensor head and connected to said computation means for communicating output signals from said computation means to a general network communication means; and said general network communication means being interconnected between said communication control means and said interface means for providing output signals from said communication control means to be monitored and upon instructions from said interface means said output signals are used to control said sheet manufacturing process; and wherein said sensor means comprises a plurality of replaceable sensors; said computation means comprises a corresponding number of replaceable computation devices; and said communication control means comprises a corres ponding number of replaceable communication control devices.

2. The system of claim 1, wherein said plurality of sensors are of the same category but of different measuring ranges.

3. The system of claim 1, wherein said computation means comprise means for combining a measurement signal from said sensor means with information on sensor means position.

4. The system of claim 3, wherein said computation means comprises means for computing paper profiles.

5. The system of claim 1, wherein said interface means comprises first display means for displaying measured values, and a second display means comprising a zoom-in display means, wherein said first display means and said zoom-in display means are concurrently displayed side-by-side on a commnon display means so that measured variables and instructions are concurrently displayed.

* * * * *